United States Patent [19]

Repplinger

[11] 4,215,257

[45] Jul. 29, 1980

[54] PRECISION TOGGLE SWITCH

[75] Inventor: Thomas J. Repplinger, Cary, Ill.

[73] Assignee: Otto Engineering, Inc., Carpentersville, Ill.

[21] Appl. No.: 961,954

[22] Filed: Nov. 20, 1978

[51] Int. Cl.[2] ..... H01H 23/30

[52] U.S. Cl. ..... 200/153 T; 200/67 G; 200/330

[58] Field of Search ..... 200/18, 67 G, 68, 153 T, 200/302, 330, 339, 318

[56] References Cited

U.S. PATENT DOCUMENTS

| | | | |
|---|---|---|---|
| 2,248,361 | 7/1941 | Krieger | 200/67 G X |
| 2,832,852 | 4/1958 | Andrew | 200/18 |
| 2,857,485 | 10/1958 | Brooks | 200/67 G X |
| 2,861,156 | 11/1958 | Kulka | 200/302 |
| 2,870,299 | 1/1959 | Cox | 200/330 X |
| 2,885,905 | 5/1959 | Larkin | 200/302 X |
| 3,001,417 | 9/1961 | Becker et al. | 200/318 X |
| 3,008,024 | 11/1961 | Roeser | 200/67 G X |
| 3,237,460 | 3/1966 | Morse | 200/339 X |
| 3,322,914 | 5/1967 | Puccini | 200/302 X |
| 3,569,655 | 3/1971 | Jakubauskas | 200/330 |
| 3,598,943 | 8/1971 | Barrett | 200/153 T X |
| 3,604,286 | 9/1971 | Foreman | 200/339 X |
| 4,117,284 | 9/1978 | Kirchoff et al. | 200/67 G |

FOREIGN PATENT DOCUMENTS

| | | | |
|---|---|---|---|
| 649862 | 10/1962 | Canada | 200/67 G |

*Primary Examiner*—Stephen Marcus

[57] ABSTRACT

A toggle switch includes a double-pivoting actuator for alternately actuating at least a pair of switches and a pivotable toggle lever having detents for maintaining the toggle lever in one or more positions. The toggle lever includes a spherically shaped pivot portion which is provided with a pair of flat surfaces for preventing rotation of the toggle lever about its longitudinal axis.

4 Claims, 6 Drawing Figures

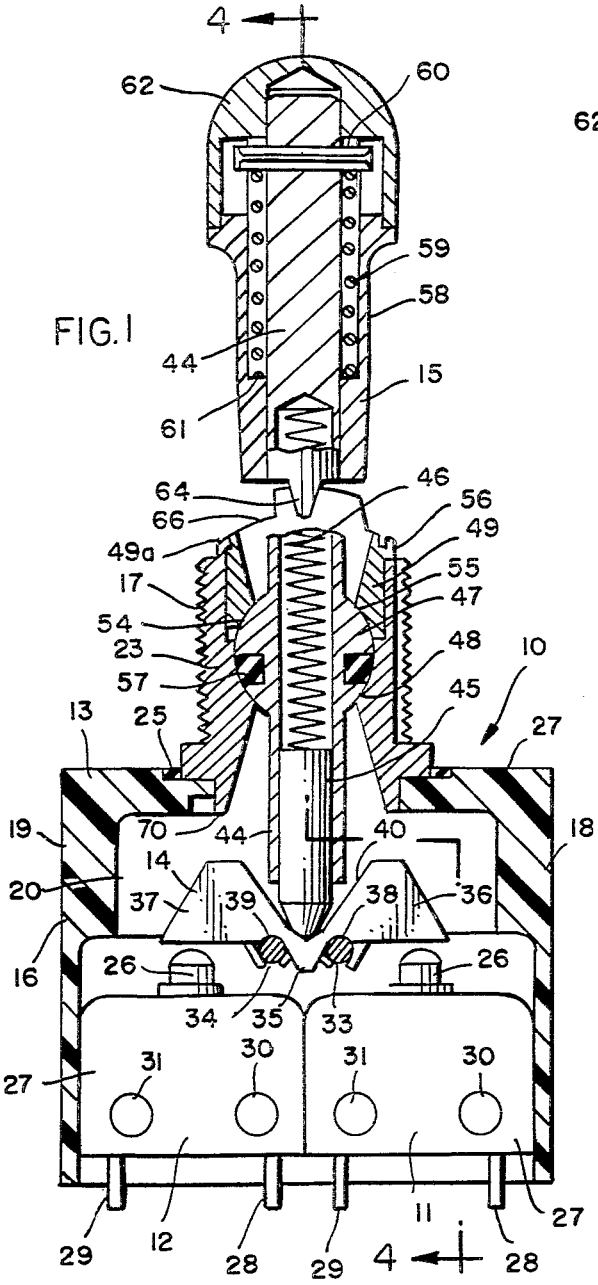
FIG. 1
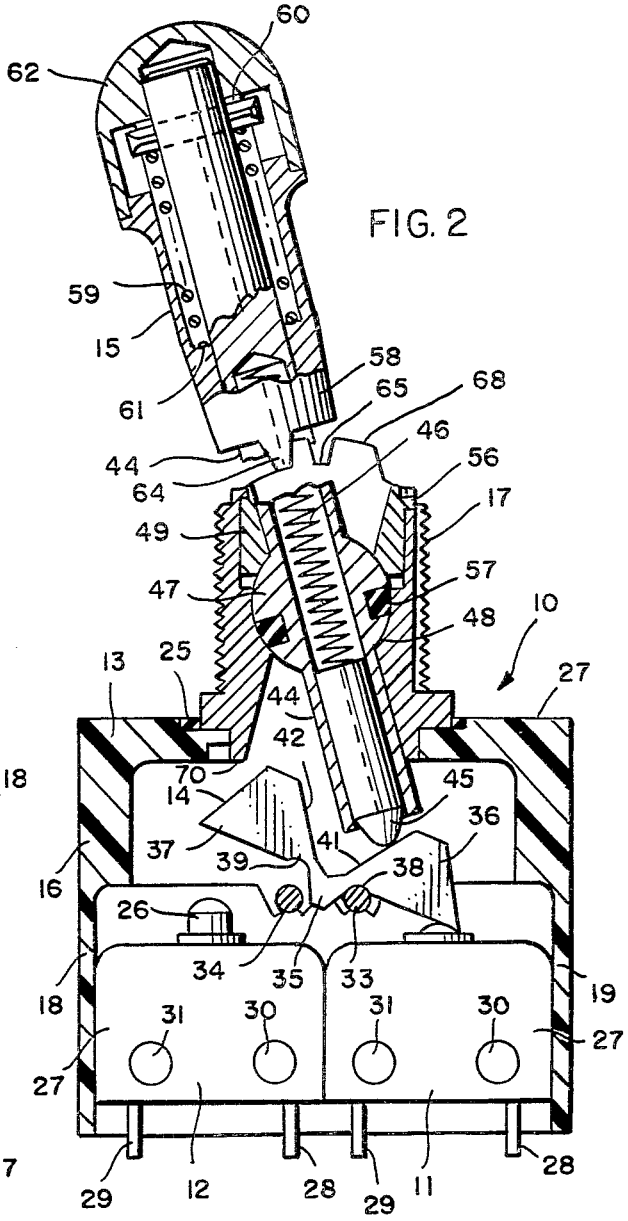
FIG. 2
FIG. 6
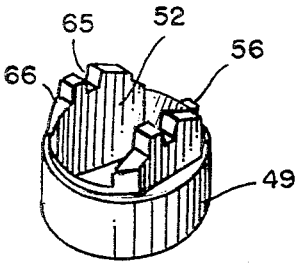
FIG. 5
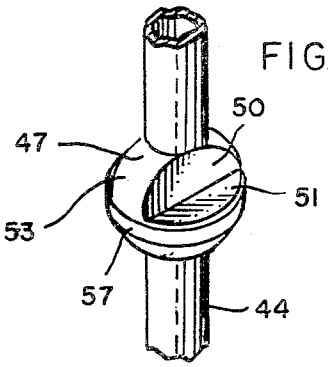

PRECISION TOGGLE SWITCH

BACKGROUND AND SUMMARY

This invention relates to toggle switches, and, more particularly, to a simple yet precise toggle switch in which a pivotable toggle lever is engageable with a double-pivoting actuator, is detented in one or more positions, and is prevented from rotating about its longitudinal axis.

Many toggle switches are available which include a toggle lever which is pivotable into two or more positions and which actuates a plurality of switches. However, recurring problems with toggle switches include lack of precision or inability to actuate all of the switches simultaneously, unsatisfactory detenting mechanisms, and a poor seal between the pivoting toggle lever and the switch casing. These problems have been compounded as additional parts have been introduced into the switch mechanism in an effort to solve one or more problems. As the number of parts increases, the expense and unreliability of the switch increase.

The invention provides a toggle switch mechanism that is simple, i.e., has relatively few parts, and is easy to assemble, and is therefore economical, but yet a switch mechanism that is highly precise. The toggle switch mechanism is adapted for use with two sets of a plurality of switches, and an actuator is pivotable into two actuating positions for actuating the switches of the two sets. The switches of each set are actuated substantially simultaneously by the actuator. A ball and socket joint for the toggle lever includes mating flat surfaces for preventing rotation of the toggle lever, and the joint is sealed by an O-ring which is mounted on the ball. The outer end of the toggle lever cooperates with the switch casing to detent the lever in one or more positions.

DESCRIPTION OF THE DRAWING

The invention will be explained in conjunction with an illustrative embdiment shown in the accompanying drawing, in which FIG. 1 is a sectional elevational view, partialy broken away, of a toggle switch formed in accordance with the invention, the toggle lever being shown in its neutral or unactuated position;

FIG. 2 is a view similar to FIG. 1 with the toggle lever in one of its actuated positions;

FIG. 5 is a perspective view of the central portion of the toggle lever showing the ball joint; and FIG. 6 is a perspective view of the cylindrcal collar which provides part of the ball-and -socket join for the toggle lever.

DESCRIPTION OF SPECIFIC EMBODIMENT

Figure 3:
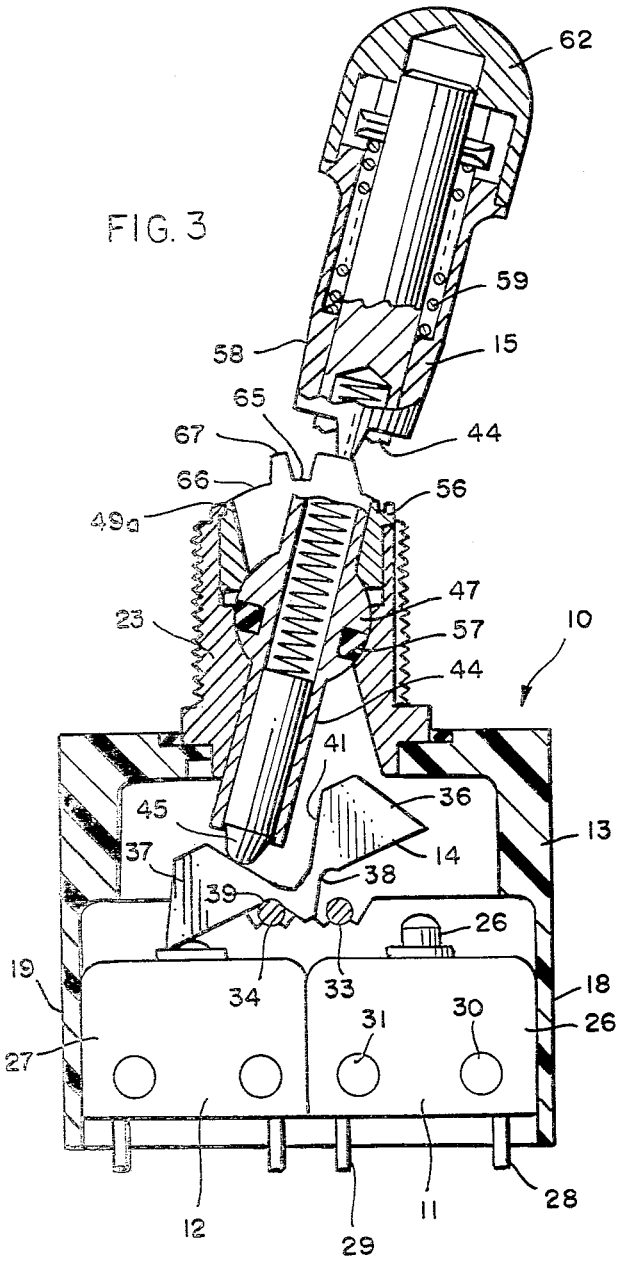
FIG. 3 is a view similar to FIG. 1 with the toggle lever in its other actuated position.

The numeral 10 designates generally a toggle switch which includes two sets 11 and 12 of pushbuttom switches mounted within a casing 13. The switches are actuated by a pivoting acutator 14 which is pivoted by a toggle lever 15.

The casing includes a lower box-like portion 16 and an upper cylindrical portion 17. The lower portion includes end walls 18 and 19, side walls 20 and 21 (FIG. 4), and a top wall 27. The upper portion includes a cylindrical bushing 23, which is mounted in an opening in the top wall. The joint between the bushing and the top wall is sealed by epoxy 25.

The set 11 of switches includes four separate switches **11*a*, 11*b*, 11*c*, and 11*d* (FIG. 4), and the set 12 similarly includes four separate switches. Each of the switches includes a push button 26, a casing 27, and at least a pair of terminals 28 and 29 which extend downwardly from the casing. The push buttons of each set are aligned on opposite sides of the center line of the switch casing which extends through the cylindrical upper portion. The toggle lever is aligned with the center line when it is in its unactuated position shown in FIG. 1. Each set of switches is precisely located within the casing by a pair of pins 30 and 31 which extend between the side walls 20 and 21 and through the switch casings 27**.

The push button switches are commercially available precision switches which are advantageously manufactured in accordance with precise specifications regarding pretravel, actuation, and overtravel. Any desired number of switches can be included in each set by varying the length of the casing between the side walls 20 and 21.

The actuator 14 is mounted for pivoting movement on a pair of parallel pins 33 and 34 which extend between the side walls 20 and 21 of the casing 13. The actuator includes a generally V-shaped lower central portion 35 which extends between the pins when the actuator is in its unactuated position shown in FIG. 1 and a pair of actuating portions 36 and 37 which extend outwardly from the central portion. Each of the actuating portions has a flat lower surface for engaging the push buttons of one of the sets of the pushbutton switches ang generally semi-cylindrical grooves 38 and 39 for the pins 33 and 34 which are located between the flat surfaces and the central portion. The uper surface of the actuator is provided with a generally V-shaped groove 40 having inclined side walls 41 and 42.

Figure 4:
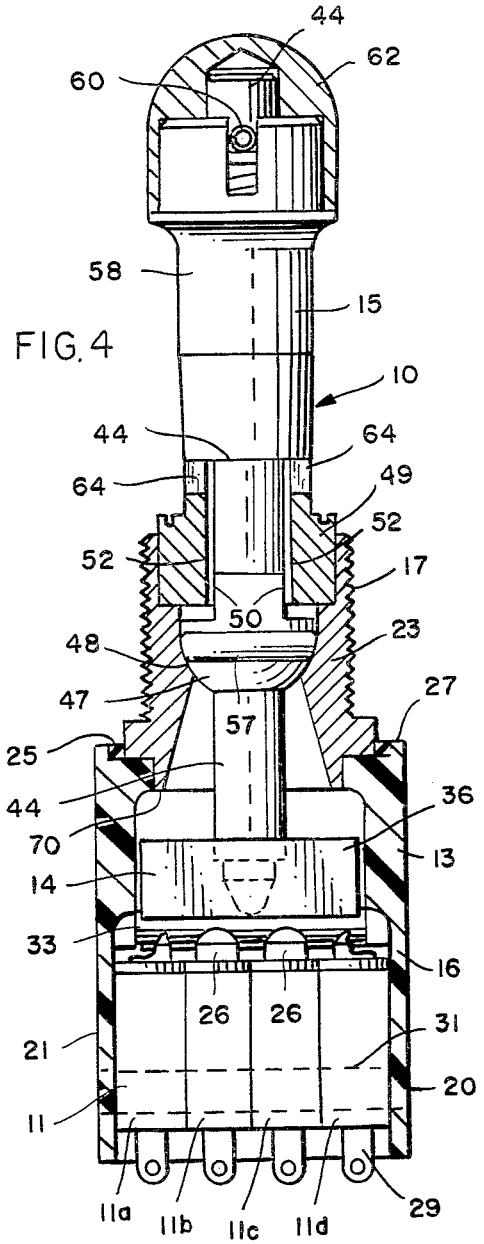
FIG. 4 is a sectional view taken along the line 4—4 of FIG. 1.

When the actuator is in its unactuated position, both of the grooves 38 and 39 are seated on the pins 33 and 34. When the actuator is pivoted by the toggle lever as shown in FIG. 2, the actuator pivots about the pin 33, and the groove 39 swings away from the pin 34. When the actuator is pivoted by the toggle lever as shown in FIG. 3, the actuator pivots about the pin 34, and the groove 38 swings away from the pin 33. Referring to FIG. 4, the actuator extends for substantially the entire distance between the side walls 21 and 22, and each actuating portion of the actuator is engageable simultaneously with every push button of one of the sets of switches.

The toggle lever includes a generally cylindrical housing 44 and an actuating plunger 45 which is reciprocably mounted in the housing. The plunger is resiliently biased into engagement with the actuator 14 by a spring 46 within the housing.

The cylindrical housing 44 includes a generally hemispherically shaped ball portion 47 which is seated in a correspondingly shaped socket 48 in the bushing 23 of the casing. A generally cylindrical or annular collar 49 is inserted into the bushing over the ball to retain the ball in the socket. The collar 49 is retained in the busing 23 by staking over a ridge **49*a* on the top of bushing 23 (FIGS. 1 and 3**).

Comparing FIGS. 1, 4, and 5, the upper portion of the ball portion 47 of the cylindrical housing includes a pair of flat surfaces 50 which extend parallel to the longitudinal axis of the housing and a pair of flat surfaces 51 which extend perpendicularly to the surfaces 50. The surfaces 50 mate with flat surfaces 52 (FIGS. 4 and 6) on the inside of the collar 49, and the curved portions 53 (FIG. 5) of the ball between the flat surfaces 50 mate with curved surfaces 54 and 55 on the inside of the collar. The ball is therefore pivotable within the socket of the bushing in a plane which extends through the axis of the cylindrical housing parallel to the flat surfaces 50, but the mating flat surfaces 50 and 52 of the ball and the collar prevent pivoting in any other plane and prevent rotation of the cylindrical housing along its longitudinal axis. The toggle lever is therefore pivotable only in a plane which extends perpendicularly to the pins 33 and 34 about which the actuator pivots. A locating tab 56 projects radially outwardly from the upper end of the collar and is received in a slot in the bushing for locating the flat surfaces of the collar perpendicularly with respect to the pins.

A sleeve 58 is reciprocably mounted on the upper end of the cylindrical housing of the toggle lever and is resiliently biased downwardly toward the actuator by a coil spring 59. The spring is compressed between a pin 60 which extends through the upper end of the cylindrical housing and an annular shoulder 61 on the inside of the sleeve. A cap 62 encloses the upper end of the cylindrical housing and is secured to the sleeve.

The lower end of the sleeve 58 includes a pair of diametrically opposed detent projections 64 which extend downwardly toward the plunger of the toggle lever. Each of the detent projections are receivable in detent grooves 65 and 66 (see FIGS. 3 and 6 ) in the upper edge of the collar 49. The collar also includes a short surface 67 (FIG. 3) between the grooves 65 and 66 and a longer surface 68 (FIG. 2) to the right of groove 66 as viewed in FIGS. 1 and 3.

When the toggle lever is in its unactuated position shown in FIG. 1, the plunger is forced against the bottom of the groove in the actuator 14 by the spring 46, and the actuator is seated against both of the pivot pins 33 and 34. Both of the actuating portions 36 and 37 of the actuator are out of contact with the pushbuttons of the switches. The detent projections 64 are held in the detent grooves 65 by the spring 59 in the upper end of the toggle lever to prevent pivoting movement of the toggle lever.

When it is desired to actuate the pushbuttons of the set 11 of switches, the sleeve 58 on the upper end of the toggle leveris pulled upwardly against the bias of the spring 59 until the detent projection is withdrawn from the detent groove 65. The toggle lever is then pivoted as shown in FIG. 2 so that the plunger 45 engages the inclined wall 41 of the actuator, causing the actuator to pivot on the pin 33 until the pushbuttons of the set 11 are depressed. All of the pushbuttons are depressed simultaneously. The plunger 45 is forced into the cylindrical housing against the bias of the spring 46 as the plunger rides up the inclined wall 41 of the actuator.

As soon as the toggle lever is pivoted sufficiently to bring the detent projections over the sort flat surfaces 67, the upward force on the sleeve 58 can be released. The spring 59 will force the detent projections against the flat surface, and as the pivoting of the toggle lever continues, the detent projections will drop into the detent groove 66 as the pushbuttons are depressed. The grooves 66 prevent the toggle lever from moving out of the actuating position shown in FIG. 2 unless the sleeve 58 is pulled upwardly to withdraw the detent projections from the grooves.

Pivoting the toggle lever from its FIG. 1 position to its FIG. 3 position will cause the actuator to pivot about the pivot pin 39 and depress the pushbuttons of the set 12 of switches. In this position the detent projections engage the long flat surfaces 68, and the toggle lever can be returned to its unactuated position merely by pivoting the toggle lever toward its FIG. 1 position without exerting an upward force on the sleeve 58.

It will be understood that the configuration of the detenting edges of the collar 49 can be varied as desired to provide different detenting operations. For example, detent grooves can be provided for maintaining the toggle lever in its FIG. 3 position, the grooves 65 can be eliminated so that the toggle lever can be moved between its FIG. 2 and FIG. 3 positions without raising the sleeve, etc.

The toggle switch has relatively few parts, and the switch can be assembled easily. Even though the switch can be assembled quickly, the various parts are located relative to each other to provide accurate and precise switching action. The pushbutton switches are located and fixed by the pins 30 and 31 which are mounted in the side walls 20 and 21 of the casing, and the actuator 14 is located by the pins 33 and 34, which are also mounted in the side walls. The actuator is advantageously injection molded from plastic so that the dimensions can be held to relatively close tolerances. The flat surfaces 52 of the collar 49, which prevent rotation of the toggle lever, are located perpendicularly to the pins 33 and 34 by the projection 56 on the collar. The bushing 23 is located in the lower portion of the casing by keys or splines on the lower edge 70 of the bushing which is inserted into the opening in the lower portion of the casing.

The upper portion of the toggle switch is sealed by the epoxy 25 around the periphery of the bushing and by the O-ring 57, which seals the ball-and-socket joint, and the bottom of the toggle switch can be sealed by potting the open lower end of the casing after the pushbutton switches are mounted within the casing.

While in the foregoing specification a detailed description of a specific embodiment of the invention was set forth for the purpose of illustration, it will be understood that many of the details hereingiven may be varied considerably by those skilled in the art without departing from the spirit and scope of the invention.

I claim:

1. A toggle switch comprising a casing having a pair of spaced-apart walls, a pair of pushbutton switches mounted in the casing between the walls, a pair of parallel pivot pins extending between the walls and mounted therein, an actuator supported by the pivot pins, the actuator being pivotable in one direction about one of the pivot pins for engaging the pushbuttons of one of the switches and being pivotable in the opposite direction about the other pivot pin for engaging the pushbutton of the other switch, and a toggle lever pivotally mounted in the casing and engaging the actuator for pivoting the actuator about the pivot pins.

2. The toggle switch of claim 1 in which the actuator includes a lower surface having a pair of parallel grooves for receiving the pivot pins and an upper surface having a pair of inclined walls which provide a generally V-shaped recess for receiving the toggle lever, the inclined walls being engageable by the toggle lever when the toggle lever pivots.

3. The toggle switch of claim 1 in which each of said switches belongs to one of two sets of a plurality of pushbutton switches mounted in the casing, the pushbuttons of each set of switches being aligned in a direction parallel to the support pins whereby the pushbuttons of one set are engaged substantially simultaneously by the actuator when the actuator is pivoted in one direction and the pushbuttons of the other set are engaged substantially simultaneously by the actuator when the actuator is pivoted in the other direction.

4. The toggle switch of claim 1 in which the toggle lever includes a ball-shaped pivot portion having a first hemispherical portion and a second portion having a pair of flat surfaces separated by a pair of curved surfaces, the hemispherical portion being pivotally supported by a hemispherically shaped socket in the casing, the casing having a generally cylindrical collar having a pair of opposed interior curved surfaces which are engageable with the curved surfaces of the second portion of the pivot portion of the toggle lever and a pair of opposed interior flat surfaces which are engageable with the flat surface of the second portion of the pivot portion of the toggle lever, the flat surfaces of the toggle lever and of the casing extending perpendicularly to the pivot pins whereby the toggle lever is confined to pivot in a plane extending perpendicularly to the pivot pins, and an O-ring mounted on the hemispherical portion of the pivot portion of the toggle lever and sealingly engaging the hemispherical socket in the casing.

* * * * *